United States Patent [19]

Stursa

[11] Patent Number: 4,655,534

[45] Date of Patent: Apr. 7, 1987

[54] RIGHT ANGLE COAXIAL CONNECTOR

[75] Inventor: Lloyd C. Stursa, Owatonna, Minn.

[73] Assignee: E. F. Johnson Company, Waseca, Minn.

[21] Appl. No.: 712,554

[22] Filed: Mar. 15, 1985

[51] Int. Cl.[4] ..... H01R 17/18

[52] U.S. Cl. ..... 339/177 R; 339/217 R; 339/220 R

[58] Field of Search ..... 339/177, 217 R, 217 S, 339/220 R, 221 R, 143 R

[56] References Cited

U.S. PATENT DOCUMENTS

| | | | |
|---|---|---|---|
| 2,813,144 | 11/1957 | Valach | 339/177 R |
| 2,817,086 | 12/1957 | Bystrom, Jr. et al. | 339/177 R |
| 2,937,360 | 5/1960 | True | 339/177 R |
| 2,952,823 | 9/1960 | Robinson | 339/177 R |
| 3,047,828 | 7/1962 | Gregson et al. | 339/177 R |
| 3,141,718 | 7/1964 | Schott et al. | 339/177 R |
| 3,480,722 | 11/1969 | Van Horssen et al. | 339/177 R |
| 3,528,052 | 9/1970 | Brishka | 339/177 R |
| 3,553,835 | 1/1971 | Demler, Sr. et al. | 339/177 R |
| 3,555,672 | 1/1971 | O'Keefe et al. | 339/177 R |
| 3,566,007 | 2/1971 | O'Keefe | 339/177 R |
| 3,566,334 | 2/1971 | Ziegler, Jr. | 339/177 R |
| 3,569,903 | 3/1971 | Brishka | 339/177 R |
| 3,579,282 | 5/1971 | Couper | 339/177 R |
| 3,588,982 | 6/1971 | Ziegler, Jr. | 339/177 R |
| 3,590,481 | 7/1971 | Felty | 339/177 R |
| 3,599,166 | 8/1971 | Cea | 339/177 R |
| 3,622,939 | 11/1971 | Forney, Jr. | 339/166 R |
| 3,639,889 | 2/1972 | Komadina | 339/177 R |
| 3,646,502 | 2/1972 | Hutter et al. | 339/177 R |
| 3,668,608 | 6/1972 | Ziegler, Jr. | 339/177 R |
| 3,670,293 | 6/1972 | Garver | 339/177 R |
| 3,673,547 | 6/1972 | Ziegler, Jr. | 339/177 R |
| 3,678,446 | 7/1972 | Siebelist | 339/177 R |
| 3,678,447 | 7/1972 | Ziegler, Jr. et al. | 339/177 R |
| 3,717,930 | 2/1973 | Apa | 339/177 R |
| 3,745,514 | 7/1973 | Brishka | 339/177 R |
| 3,757,278 | 9/1973 | Schumacher | 339/177 R |
| 3,769,395 | 10/1973 | Schmacher | 339/177 R |
| 3,778,535 | 12/1973 | Forney, Jr. | 339/177 R |
| 3,782,840 | 1/1974 | Brishka | 339/177 R |
| 3,824,528 | 7/1974 | Esser | 339/177 R |
| 3,824,686 | 7/1974 | Forney, Jr. | 339/177 R |
| 3,828,305 | 8/1974 | Hogendobler | 339/177 R |
| 3,864,011 | 2/1975 | Huber | 339/177 R |
| 3,869,187 | 3/1975 | Bingham | 339/177 R |
| 3,907,396 | 9/1975 | Huber | 339/177 R |
| 3,909,506 | 9/1975 | Campari et al. | 339/177 R |
| 3,943,470 | 3/1976 | Bingham | 339/177 R |
| 4,017,139 | 4/1977 | Nelson | 339/177 R |
| 4,019,802 | 4/1977 | Shannon et al. | 339/177 R |
| 4,035,050 | 7/1977 | Volinskie | 339/177 R |
| 4,040,704 | 8/1977 | Huber | 339/177 R |
| 4,040,705 | 8/1977 | Huber | 339/177 R |
| 4,047,788 | 9/1977 | Forney, Jr. et al. | 339/177 R |
| 4,070,751 | 1/1978 | Hogendobler | 339/177 R |
| 4,096,627 | 6/1978 | Forney, Jr. et al. | 339/177 R |
| 4,120,554 | 10/1978 | Bianchi et al. | 339/177 R |
| 4,131,332 | 12/1978 | Hogendobler et al. | 339/177 R |
| 4,138,184 | 2/1979 | Knopp | 339/177 R |
| 4,138,188 | 2/1979 | Shannon | 339/177 R |
| 4,163,594 | 8/1979 | Aujla | 339/177 R |
| 4,163,598 | 8/1979 | Bianchi et al. | 339/177 R |
| 4,165,911 | 8/1979 | Laudig | 339/177 R |
| 4,249,790 | 2/1981 | Ito et al. | 339/177 R |
| 4,326,769 | 4/1982 | Dorsey et al. | 339/177 R |
| 4,333,697 | 6/1982 | Dreyer | 339/177 R |
| 4,346,958 | 8/1982 | Blanchard | 339/177 R |
| 4,355,857 | 10/1982 | Hayward | 339/177 R |
| 4,358,174 | 11/1982 | Dreyer | 339/177 R |
| 4,412,717 | 11/1983 | Monroe | 339/177 R |
| 4,445,745 | 5/1984 | Cartesse | 339/276 R |
| 4,508,418 | 4/1985 | Gagne | 339/217 S |

*Primary Examiner*—Eugene F. Desmond
*Assistant Examiner*—David Pirlot
*Attorney, Agent, or Firm*—Dorsey & Whitney

[57] ABSTRACT

A minature right angle coaxial connector is provided that enables a coaxial cable to be connected to a standard SMB mating connector. A stamped and formed interface is housed in the connector that has outwardly oriented multiple spring leaf barbs for securing the interface to the inner surface of the connector, and inwardly oriented multiple spring leaf barbs that secure a dielectric to the interface. The unique nature of the multiple spring leaf barbs on the interface makes it possible to diecast, instead of machine, the connector housing parts, and eliminates the need for precious metal plating to ensure conductivity between parts.

6 Claims, 4 Drawing Figures

RIGHT ANGLE COAXIAL CONNECTOR

BACKGROUND OF THE INVENTION

1. Field of the Invention

The present invention relates to a minaiture coaxial cable connector for interconnecting a coaxial cable and all types of standard SMB mating connectors. More specifically, the present invention relates to a right angle connector for such an application that is diecast and includes a stamped and formed receptacle interface that is designed to mate with and secure a similar mateable connector.

2. Background Art

A review of the art in the area of coaxial connectors reveals that, despite the simple end to which these inventions have been directed, the connectors have been generally overly complex, difficult to manufacture and, thus, costly. Nearly all of the connectors that provide at least some degree of positive locking force have outer body portions comprised of multiple parts that are machined. Machining and assembling these parts is time-consuming and expensive. Furthermore, because of the normally inadequate contact force between the many parts in prior art connectors, precious metals must be applied to ensure the necessary electrical conductivity from one part to another.

A connector that can be used for connecting a coaxial cable to a standard SMB mating connector, that is made of a small number of parts, that eliminates the need for precious metal plating between parts, and that uses parts that are diecast, and thus lower in cost, would be greatly welcomed.

SUMMARY OF THE INVENTION

The present invention contemplates a connector that terminates a coaxial cable and makes it mateable to a mating connector that meets standard military specifications. The connector consists of a unitary body portion having a coaxial cable termination stem and a mating portion that accepts a mateable connector. A termination housing that allows the cable to be crimped or soldered to the connector is disposed at the apex of the connector. The termination stem consists of a ferrule, upon which the cable is forced, and a housing member that crimpably secures the cable to the termination stem. The mating portion of the connector consists of a center conductor, a dielectric surrounding that conductor, a stamped and formed receptacle interface surrounding the dielectric, and, finally, a housing member surrounding the receptacle interface.

The coaxial cable which is secured on the termination stem is run into the termination housing and secured to the center conductor of the mating portion. The stamped and formed receptacle interface is designed to accept the outer conductive portion of another mating connector. The receptacle interface is held spaced apart and insulated from the center conductor by way of the dielectric and is held firmly in the mating portion by way of multiple spring leaf barbs that extend generally radially outwardly from the surface of the receptacle. Another set of multiple spring leaf barbs are oriented radially inwardly from the surface of the receptacle and secure the dielectric within the body portion.

The receiving end of the receptacle portion is comprised of multiple spring leaves that form a flexible detent contact and lead-in for a standard SMB connector. The structure of the receptacle makes engagement of the connector to a mateable SMB connector quick but positive.

DESCRIPTION OF THE PREFERRED EMBODIMENT

Figure 1:
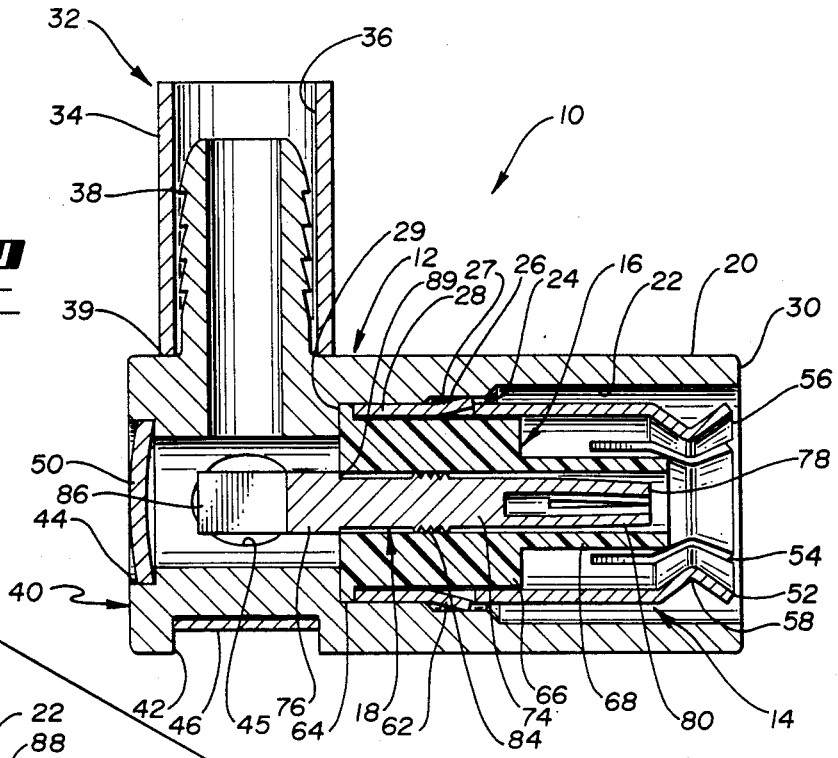
FIG. 1 is a cross sectional view of a coaxial connector in accordance with the present invention.
Figure 2:
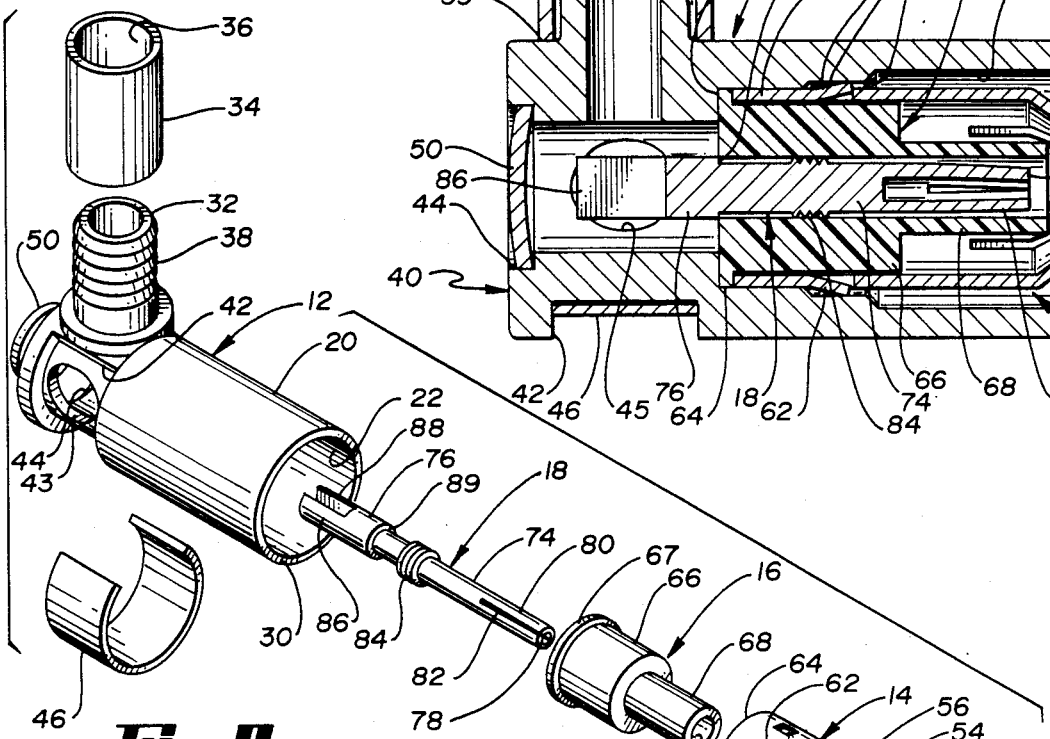
FIG. 2 is an exploded perspective view of the invention.

Referring to the drawings, a right angle coaxial connector 10 in accordance with the present invention broadly includes a unitary body portion 12, a stamped and formed receptacle portion 14, a dielectric 16, and a center contact 18.

The unitary body portion 12 has two axes in right angle relationship to each other. On one axis is the mating portion having a housing member 20. The housing member 20 is an integrally diecast element of the body portion 12 and is generally cylindrical in shape. The inner surfaces 22, 24, 26, 27 and 28 of the housing member make up a three tier wall structure defining the interior circumference of the housing member 20. The inner diameter of the housing member 20 decreases from a point adjacent the inner surface 22 to a point adjacent the inner surface 28. Separating the inner surface 22 and the inner surface 26 is the transitional surface 24 which is at an angle to the longitudinal axis of the housing member 20. Separating the inner surface 26 and the inner surface 28 is the transitional surface 27, also at an angle to the longitudinal axis of the housing member 20.

The second integral element of the unitary body portion is termination stem 32. The termination stem 32 is at a right angle to the housing member 20 and comprises a ferrule 38, generally cylindrical in shape, having annular ribs integral with its outer surface and a housing 34. The interior surface of the termination stem 32 is even. The housing 34 surrounds the ferrule 38 and has an interior surface 36. The housing 34 is secured to the unitary body portion 12 at junction 39 by crimping or swaging the housing 34 to the ferrule 38 of the termination stem 32.

The termination housing 40 integrally joins the housing member 20 and stem 32. The termination housing 40 has a recessed portion 42 that is of lesser diameter than the outer diameter of the housing member 20. The recessed portion 42 includes access ports 43, 44 and 45 running therethrough. Ports 43 and 45 open perpendicular to the longitudinal axes of housing member 20, and port 44 opens in alignment with the housing member longitudinal axis. The space within the termination housing 40, accessed by access ports 43, 44 and 45 communicates with the interiors of both housing member 20 and termination stem 32. A roll formed or stamped frusto-circular in cross section cover plate 46 fits within the recessed portion 42 of the termination housing 40 to cover the access ports 43 and 45. A concave/convex disc-shaped cover plate 50 fits over access port 44.

The receptacle interface 14 is formed from beryllium copper and stamped and formed into a generally cylindrical shape of lesser diameter than the inner housing member 20 at inner wall 28. The receptacle interface 14 can also be made from other suitable spring material.

The receiving end 52 of the receptacle interface 14 comprises spring leaf members 54 separated by slots 56 spaced about the circumference of the receptacle interface 14. Also formed near the receiving end 52 of the receptacle interface 14 is a fixed detent contact 58. The detent contact 58 comprises an inwardly directed groove in the otherwise generally uniform-in-diameter outer surface of the receptacle interface 14. A seam 60 is defined by the opposed lateral margins of the receptacle interface 14. Multiple spring leaf barbs 62 are alternately directed inwardly and outwardly about the circumference of the receptacle interface 14 at the mounting end 64 of receptacle interface 14. The spring leaf barbs 62 are integrally formed as part of receptacle interface 14. The outwardly oriented spring leaf barbs 62 are directed toward the receiving end 52 of receptacle interface 14, and the inwardly oriented spring leaf barbs 62 are directed toward the mounting end 64 of the receptacle interface 14.

The dielectric 16 is cylindrical in shape, including three portions of distinctly different diameters. The rearward portions 66 and 67 of the dielectric 16 are of larger diameter than is the forward portion 68 of the dielectric 16. The dielectric 16 is hollow, and presents an interior dielectric channel 70. The dielectric is of lesser overall length than is the receptacle interface 14.

The center contact 18 has a forward portion 74 and a rearward portion 76. The forward portion 74 is received within the channel 70 of the dielectric 16. The center contact 18 has a tip 78 comprised of resilient portions 80 separated by slots 82. The tip 78 of the center contact 18 includes a channel defined by the spring leaves 80 that extends rearward on the center contact 18 to a point just rearwardly of the termination of the slots 82 in the center contact 18.

Disposed about the center section of the center contact 18 are multiple externally protruding ribs 84 and associated grooves. The rearward portion 76 of the center contact 18 comprises the mounting portion and has two mounting segments 86 and 88 that define a generally U-shaped channel at the end of the center contact 18. The rearward portion 76 includes a shoulder 89 that accommodates the larger size of the U-shaped channel and the mounting segments 86 and 88 and abuts against the rearward portion 67 of the dielectric 16.

The stamped and formed receptacle interface 14 is secured within the housing member 20 by the outwardly oriented spring leaf barbs 62. During assembly, the spring leaf barbs 62 pass, with little resistance, across the inner surface 22 of the housing member 20. As the rearward end 64 of the receptacle interface 14 moves rearwardly in the housing member 20, the spring leaf barbs 62 begin to ride on the transitional surface 24 between the inner surface 22 and the inner surface 26. As the spring leaf barbs 62 ride up on the transitional surface 24, they become compressed to some degree because of their spring-like nature. Thus, as the receptacle interface 14 is forced further inwardly into the housing member 20, the outwardly oriented force of the multiple spring leaf barbs 62 upon the inner surface 26 increases. As the rearward end 64 of the receptacle interface 14 abuts the shoulder 67 of the dielectric 16, the outwardly oriented force of the multiple spring leaf barbs 62 is at its greatest, provides self-fixturing of the receptacle interface 14, and ensures that the receptacle interface 14 is secured both mechanically and electrically to the housing member 20 at the inner surface 26. Also, the receptacle interface 14 lends itself to being selectively plated with solder to further enhance contact with the housing member 20 when the solder reflows and encapsulates the multiple spring leaf barbs within the housing member 20. That the joint between the interface 14 and the housing member 20 is unexposed, protects it from adverse environmental conditions and increases retention of the receptacle interface 14 in the housing member 20.

Typically, precious metal plating is needed between parts in coaxial connectors so that electrical conductivity between the parts is maintained. In the disclosed invention, however, the sufficient outwardly oriented force of the multiple spring leaf barbs 62 upon the housing member 20 at the inner surface 26 and the use of solder in the area of contact, eliminate the need for precious metal plating at that contact point.

The dielectric 16 fits within the receptacle interface 14 in a frictional manner. The inwardly oriented barbs 63 ensure that the dielectric 16 does not move within the receptacle interface 14 or within the housing member 20. Not only does the dielectric 16 frictionally contact the receptacle interface 14 over a substantial portion of the inner surface of the receptacle interface 14, but the inwardly oriented barbs 63 grab the dielectric and prevent its movement outwardly from the stop 29 on the housing member 20. In addition, the shoulder 67 on the dielectric 16 increases resistance to forward movement of the dielectric 16; the shoulder 16 is captivated between the stop 29 and the rearward portion 64 of the receptacle interface 14. The center contact 18 is held within the dielectric 16 by the ribs 84 located about the midsection of the center contact 18.

The receiving end 52 of the receptacle interface 14 is properly located nearly flush with the forward end of the housing member 20 when the connector is assembled. The dielectric 16, however, is recessed from the end 30 of the housing member 20 to a point just rearwardly of the fixed detent contact 58 in the receptacle interface 14. The forward end 78 of the center contact 18 is in turn recessed to a point rearwardly of the fixed detent contact 58 in the receptacle interface 14. The center contact extends rearwardly into the termination housing so that its end is aligned with the access port 43 as well as with the access port 44.

Figure 3:
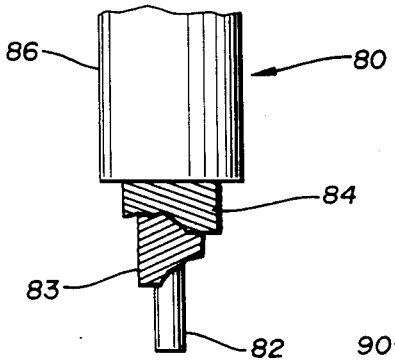
FIG. 3 is a fragmentary view of a coaxial cable.
Figure 4:
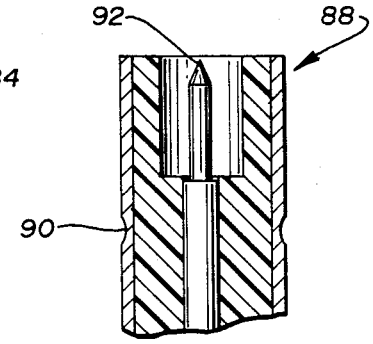
FIG. 4 is a cross sectional view of a coaxial jack.

A coaxial cable 80, as shown in FIG. 3, may be forced upon the ferrule 36 such that the inner conductor 82 of the cable and the inner dielectric 83 received within the ferrule 38 and the outer conductor 84, as well as the outer insulation 86 of the cable, is carried on the annular ribs on the outside of the ferrule 38. The outer conductor of the cable 84 and the outer insulation 86 of the cable are thus frictionally held between the ferrule 38 and the inner surface 36 of the housing 34 by crimping or swaging the housing 34 to the ferrule 38. The inner conductor 82 of the cable goes through the ferrule 32 and into the termination housing 40. The inner conductor 82 of the cable is either crimped or soldered to the two mounting segments 86 and 88 on the rear portion 76 of the center contact 18, access being provided by the convenient access ports 44 and 43. The cover plate 46 is secured within the recess portion 42 of the termination housing 40 to cover the access port 43, once the connection is complete. Likewise, the cover plate 50 is inserted to cover the access port 40. The right angle coaxial connector is now ready to be mated to an SMB connector 88 (shown in FIG. 4).

The receiving end 52 of receptacle interface 14 in the housing member 20 provides a lead-in for the SMB connector 88. As the connector is pushed onto the invention 10, the spring leaf members 54, comprising the end 56 of the receptacle interface 14, spread apart. The fixed detent contact 58 then engages a detent 90 in the mateable connector, and the tip 78 of the center contact 18 engages the center contact 92 of the mateable connector as the two connectors are brought into mated relation. The receptacle interface 14 lends itself to being selectively plated with precious metal at the fixed detent contact 58 to enhance contact between the fixed detent contact 58 and the detent 90. When the two connectors are engaged, the receptacle interface 14 electrically connects the inner and the outer conductors of those connectors and, likewise, of the cables connected to those connectors.

I claim:

1. A coaxial connector plug for mechanically and electrically connecting a coaxial jack and a coaxial cable, said jack and said cable each having spaced apart inner and outer conductors separated by a dielectric member, comprising:

a body portion having a first coupling section with a generally cylindrical inner surface adapted for receiving said coaxial jack and a second coupling section adapted for receiving said coaxial cable;

a generally tubular, coaxial jack receiving receptacle interface received within said first coupling section and adapted for mechanical and electrical connection to said coaxial jack outer conductor;

a generally tubular dielectric element received within said receptacle interface;

a center contact received within said dielectric element, said dielectric element providing electrical isolation between said receptacle interface and said center contact, said center compact adapted for mechanical and electrical connection to said coaxial jack inner conductor, said receptacle interface including a first set of multiple spring leaf barbs oriented generally radially outwardly from said receptacle interface for mechanical and electrical engagement of said receptacle interface with said first coupling section inner surface, and further including a second set of multiple spring leaf barbs oriented generally radially inwardly for mechanical engagement of said receptacle interface with said dielectric element.

2. A coaxial connector plug as recited in claim 1, said first coupling section and said second coupling section oriented generally perpendicularly respective to each other, said body portion further including a termination housing electrically and mechanically coupling said first and second coupling sections, said center contact extending into said termination housing for coupling with said inner conductor of said coaxial cable, said termination housing including structure defining access ports for providing access to within said transition housing for coupling said coaxial cable inner conductor to said center contact.

3. A coaxial connector plug as recited in claim 1, said first coupling section inner surface defining a first, inner diameter, said receptacle interface having an outer, generally cylindrical surface defining a receptacle interface diameter, said first coupling section inner surface inner diameter being just smaller than said receptacle interface diameter whereby said receptacle interface is held within said first coupling section in a force fit.

4. A coaxial connector plug as recited in claim 3, said first coupling section inner surface further including a second outer diameter, and a third, intermediate diameter, said first set of multiple spring leaf barbs defining a first spring leaf barb set outer diameter, said first coupling section intermediate diameter being smaller than said first spring leaf barb set outer diameter whereby said first set of spring leaf barbs are held within said first receptacle interface inner surface intermediate diameter in a spring biased forced fit.

5. A coaxial connector plug as recited in claim 4, said inner surface outer diameter being substantially the same as said first spring leaf barb set outer diameter, said body portion first coupling section including a generally frusto-conical transition section interconnecting said inner surface outer diameter and intermediate diameter, for urging said first set spring leaf barbs radially inwardly upon insertion of said receptacle interface within said first coupling section.

6. A coaxial connector plug as recited in claim 4, said second set of multiple spring leaf barbs defining a second spring leaf barb set inner diameter, said dielectric element defining an outer diameter larger than said second spring leaf barb set inner diameter whereby said dielectric element is held within said receptacle interface in a spring biased forced fit.

* * * * *